US005943746A

United States Patent [19]

Schramayr et al.

[11] Patent Number: 5,943,746

[45] Date of Patent: Aug. 31, 1999

[54] METHOD AND APPARATUS FOR WEFT CORRECTION

[75] Inventors: Ernst Schramayr, Barneveld; John R. Russo, Marcy, both of N.Y.; Tadeusz A. Olewicz, Moschton, Ga.

[73] Assignee: Jet Sew Technologies, Inc., Barneveld, N.Y.

[21] Appl. No.: 08/929,528

[22] Filed: Sep. 15, 1997

[51] Int. Cl.[6] ..... D06H 3/12

[52] U.S. Cl. ..... 26/51.4; 26/51.5

[58] Field of Search ..... 26/51.3, 51.4, 26/51.5, 74, 75, 76, 70; 28/151

[56] References Cited

U.S. PATENT DOCUMENTS

| | | | |
|---|---|---|---|
| 2,461,084 | 2/1949 | Robertson | 26/51.4 |
| 2,698,982 | 1/1955 | Smith et al. | 26/51.4 |
| 3,146,511 | 9/1964 | Hoffman | 26/51.4 |
| 3,192,595 | 7/1965 | Morton et al. | 26/51.5 |
| 3,324,718 | 6/1967 | Gibb | 26/51.4 |
| 3,350,933 | 11/1967 | Smith | 26/51.4 |
| 4,068,789 | 1/1978 | Young, Jr. et al. | 26/51.5 |
| 4,305,184 | 12/1981 | Woythal | 26/51.4 |
| 4,375,175 | 3/1983 | Elsas et al. . | |
| 4,493,234 | 1/1985 | Ziegler et al. . | |
| 4,768,265 | 9/1988 | Hampel . | |
| 4,788,756 | 12/1988 | Leitner, Sr. | 26/51.4 |
| 4,853,679 | 8/1989 | Duda . | |
| 4,894,891 | 1/1990 | Beckstein | 26/51.4 |
| 4,899,425 | 2/1990 | Epple . | |
| 4,932,106 | 6/1990 | Senba . | |
| 4,987,663 | 1/1991 | Epple . | |
| 5,035,030 | 7/1991 | Pellari . | |
| 5,142,751 | 9/1992 | Senba . | |
| 5,555,611 | 9/1996 | Lyczek . | |

*Primary Examiner*—Amy Vanatta

[57] ABSTRACT

A weft straightener assembly for an automated weft straightener system. The weft straightener system includes proximity sensors, a power roller, and an idler roller rotating on a rotation axis. A biased woven textile planar material is fed to the weft straightener assembly where the assembly stretches the woven planar textile material in a predetermined direction to eliminate or substantially reduce any bias present in the woven planar material.

19 Claims, 15 Drawing Sheets

METHOD AND APPARATUS FOR WEFT CORRECTION

BACKGROUND OF THE INVENTION

1. Field of the Invention

The present invention relates to a method and apparatus for correction of weft in woven textile materials. The weft straightener apparatus employs an automated system which includes a central controller, weft bias detection sensors, and a weft straightener assembly which stretches a textile planar material in a predetermined direction according to the data generated from the weft bias detection sensors.

2. Description of the Background Art

Various conventional weft straightening systems currently exist. These devices use rotating wheels or rollers which employ complex adjusting mechanisms that stretch the woven textile planar material across the rotating rollers. For example, in U.S. Pat. No. 5,555,611 (Lyzek), a roller device employing a bow roll is used with two idler rollers to substantially eliminate weft distortions.

Other weft straightening systems require an operator to manually pull biased material from the top of a fan folded pile of woven textile planar material, clench the woven textile planar material between his/her two fists and stretch the woven planar textile material in a diagonal direction opposite to the bias. The operator will normally perform this task approximately 10 to 15 times for every two feet of material. Manually removing the bias reduces the number of errors that occur when later processing the stretched woven planar material.

Unfortunately, processes such as bleaching, dyeing, and uneven sewing cause the woven textile planar materials to have as much as 2.5 inches of bias over 12 inches of width when the woven textile planar material reaches an automatic textile machine.

Accordingly, a need in the art exists for an automated weft straightener apparatus which can eliminate or minimize bias in woven textile planar materials and remove the need for manual stretching. Furthermore, a need exists in the art to eliminate or reduce bias in woven textile planar materials by stretching the materials, using an automated system, in an opposite diagonal direction relative to the bias.

SUMMARY OF THE INVENTION

Accordingly, it is a primary object of the present invention to provide an automated weft straightener system which eliminates or substantially reduces bias in woven planar materials by stretching the materials in an opposite diagonal direction relative to the bias.

It is a further object of the present invention to have an automated system capable of sensing the amount and direction of the bias in the woven planar materials and correcting the bias in accordance with these sensed data parameters.

Another object of the present invention is to provide an automated weft straightener system which closely parallels manual stretching of the woven planar materials but permits the continuous movement of woven planar materials in an automated process.

It is a further object of the present invention to provide a weft correction process with an automatic intelligent machine which removes the biases with fewer errors to increase the quality control of the woven textile planar materials.

Another object of the present invention is to significantly reduce the idle time in the manufacturing of woven textile planar materials.

It is further object of the present invention to provide an automated weft correction system which reduces the possibility of long term injuries sometimes associated with the repetitive manual processes of weft correction.

These and other objects of the present invention are fulfilled by providing a weft straightener assembly comprising a central controller, weft bias detection sensors for determining the direction and degree of bias, and a weft straightener assembly for stretching the bias to remove the bias detected by the weft bias sensors.

The preferred embodiment also includes a mounting structure adjacent a stretch table, a stretch table supporting adjacent planar materials; an adjustable frame unit; means for elevating and lowering the adjustable frame unit relative to the planar material, the means for elevating and lowering being supported by the mounting structure; means for adjusting the frame unit; and stretch feet attached to the adjustable frame unit, the stretch feet contacting the planar material at predetermined time intervals according to the central controller, the feet stretch the planar material in a direction which substantially eliminates or substantially reduces bias in the planar material.

In addition, these and other objects of the present invention are also accomplished by the weft straightener system comprising a material feed table supporting planar material; a central controller; a proximity sensor adjacent to the material feed table and providing bias direction data and bias amount data of the planar material to the central controller; an idler roller adjacent the material feed table; a power roller adjacent to the idler roller and moving the planar material around the idler roller, the power roller including a motor; and encoder adjacent to the power roller and providing count data to the central controller; and a weft straightener assembly including: a mounting structure adjacent a stretch table, the mounting structure supporting means for elevating and lowering an adjustable frame unit relative to the planar material, the adjustable frame unit including stretch feet, the stretch feet contacting the planar material at predetermined time intervals according to the central controller, the adjustable frame unit including means for adjusting the frame unit, the feet stretch the planar material in a direction to substantially eliminates or reduces bias in the planar material.

Additionally, these and other objects of the present invention are fulfilled by a weft error detection system comprising a material feed table supporting planar material; a central controller, a proximity sensor adjacent the material feed table and providing bias direction data and bias magnitude data of the planar material to the central controller; an idler roller adjacent the material feed table; a power roller adjacent to the idler roller and moving the planar material around the idler roller, the power roller including a motor; and an encoder adjacent to and contacting the power roller and providing count data to the central controller; and a support arm structure rotatably mounted adjacent to the power roller, a support arm supporting the idler roller and the proximity sensor, the support arm providing the idler roller and the proximity sensor with an axis of rotation, whereby the support arm is rotated to permit loading of the planar material.

Moreover, these and other objects of the present invention are fulfilled by a method of eliminating bias in a planar material comprising the steps of: detecting bias direction data and bias amount data of a planar material; stretching the planar material with the a weft straightener assembly in the predetermined stretch direction, whereby bias in the planar material is substantially reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
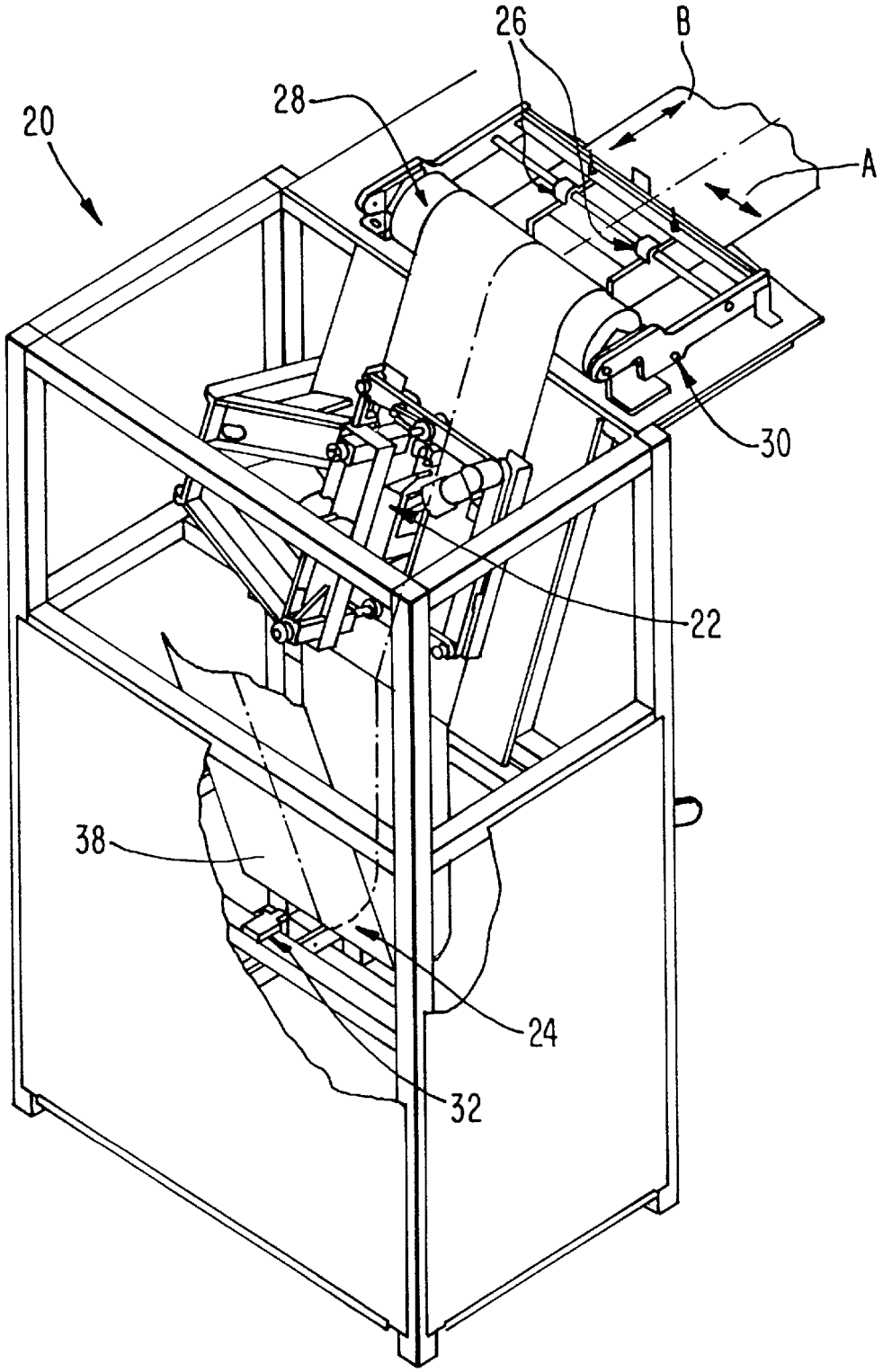
FIG. 1(A) is a perspective view of a first embodiment of the automated weft straightener system of the present invention.

Referring in detail to the drawings and with particular reference to FIG. 1, a weft straightener assembly 22 of a first embodiment is shown in an automated weft straightener system 20. The automated weft straightener system 20 further includes proximity sensors 26, a power roller 28, and an idler roller rotating on a rotation axis 30. The woven textile planar material 24 is, for example, a terry cloth material for washcloths, hand towels and bath towels. While the woven textile planar material includes terry cloth, other materials such as cotton mixtures which include woven polyester, woven wool fabrics or the like may be employed. It is contemplated that the weft straightener system 20 will be used in an automated manufacturing process where the woven planar material 24 is initially fed near the proximity sensors 26.

The power roller 28 later moves the material to the weft straightener assembly 22 which will the stretch the woven planar material 24 in a diagonal direction relative to any bias present in the woven planar material 24. Stretching in a diagonal direction is preferred since the woven planar material 24 is typically biased in a diagonal direction during wet processing of the woven planar material 24. With diagonal stretching, the woven planar material 24 is stretched across the bias in such a manner to allow for permanent contortment of the woven planar material. While the preferred stretching direction is diagonal relative to the bias, other directions of stretching may be employed which include directions parallel to the bias or staggered diagonal directional movements or a combination of parallel directional stretching and diagonal directional stretching or the like.

Figure 6:
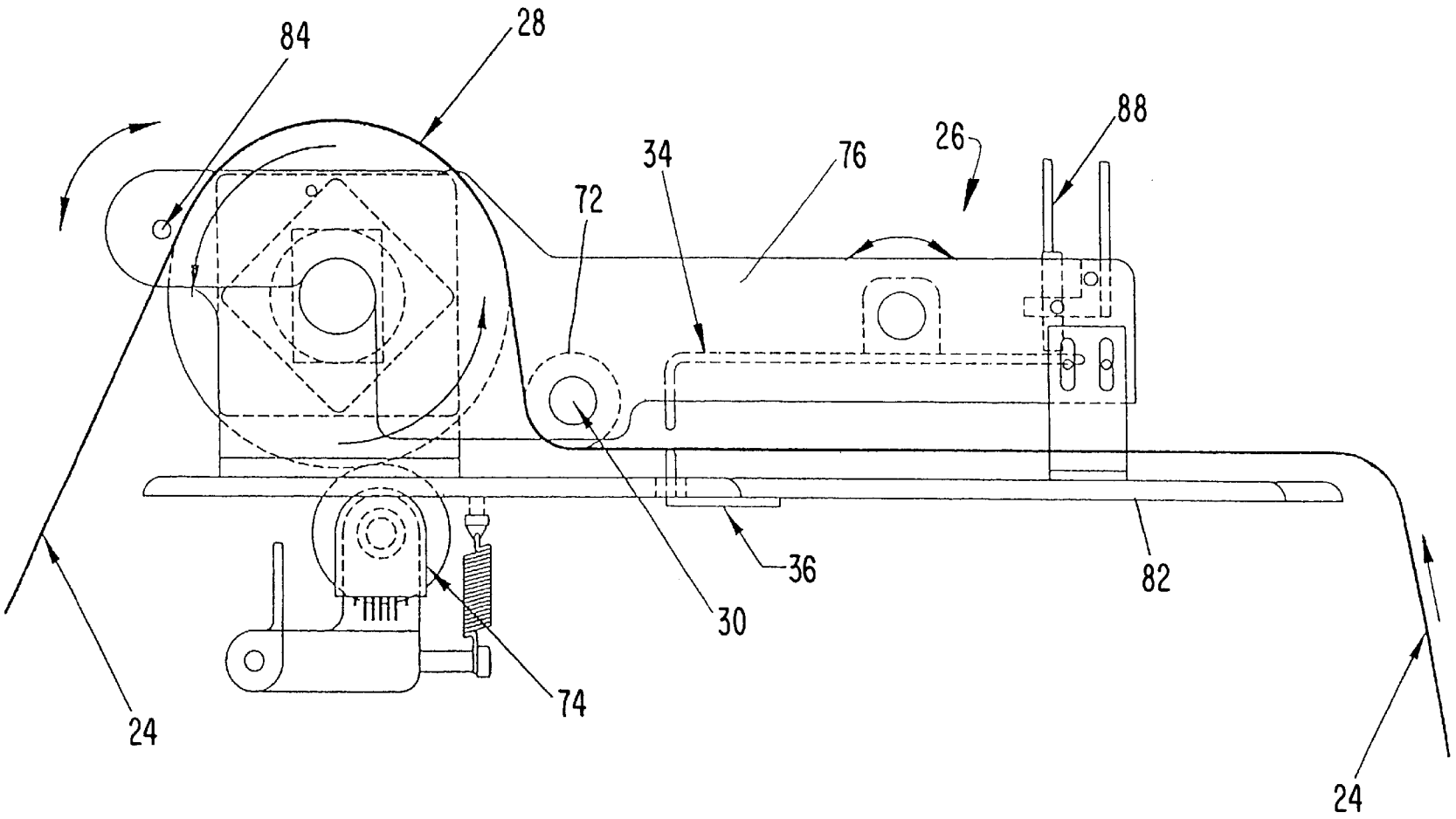
FIG. 6 is a side view of the weft error detection system of the present invention in an operating position.

The woven textile planar material 24 is initially loaded between upper and lower cut line detectors 34, 36 of the proximity sensors 26 (see FIG. 6). The woven textile planar material 24 is then fed underneath the idler roller 72 and then the woven textile planar material 25 is placed over the top surface of the power roller 28. From the power roller 28, the woven textile planar material is gravity fed to the weft straightener assembly 22 where bias in the woven planar material 24 is removed (see FIG. 1). From the weft straightener assembly 22, the woven textile planar material 24 is formed into the accumulated loop 38 beneath the weft straightener assembly 22. The advancement of the accumulated loop 38 of the woven planar material 24 is sensed by a photoelectric eye 32. It is noted that the direction of the weft of the woven planar material 24 is designated by arrow A and the direction of the warp of the woven planar material 24 is designated by the arrow B in FIG. 1.

Figure 2:
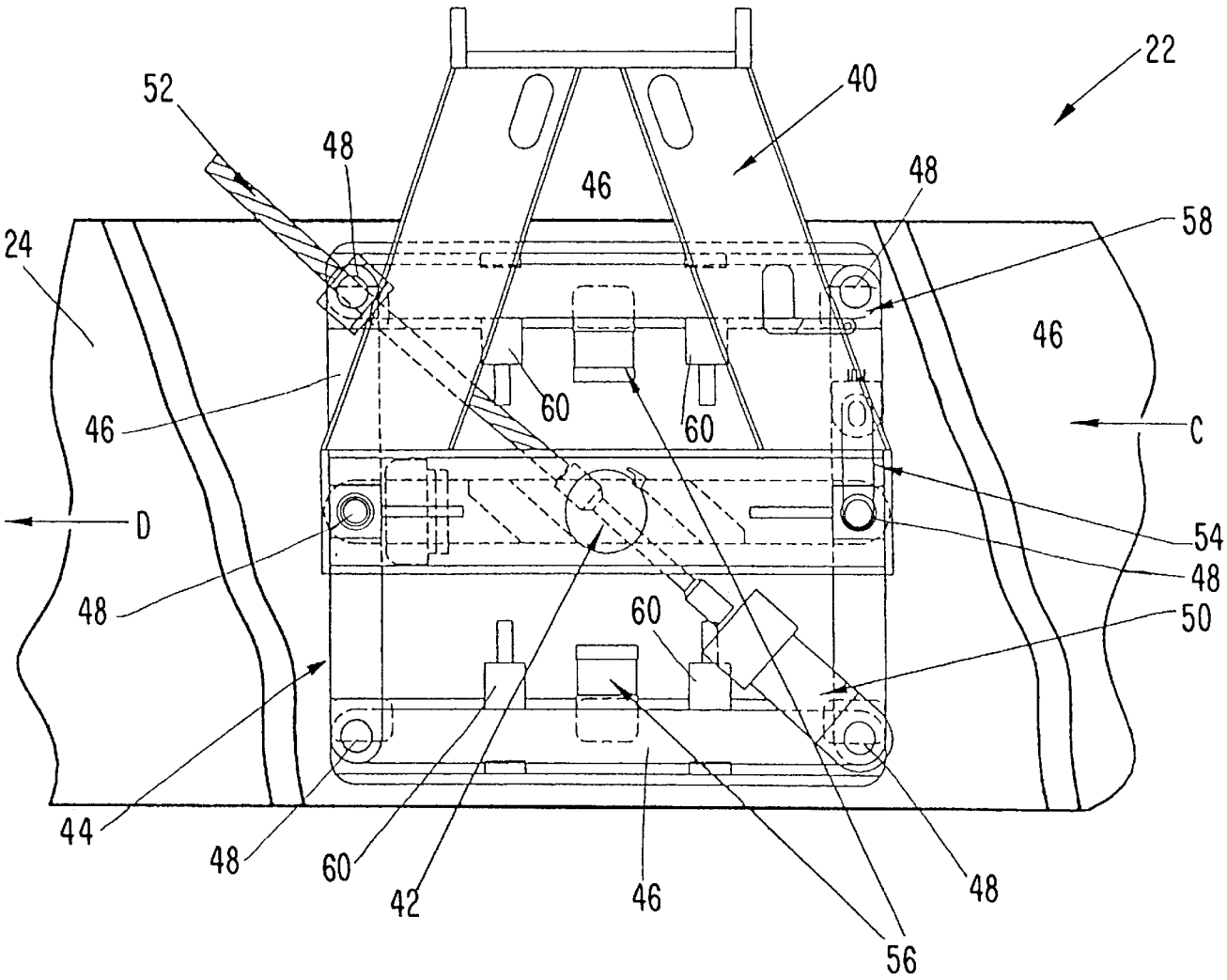
FIG. 2 is an elevational view of the first embodiment of the weft straightener assembly of the present invention in the home position.
Figure 3:
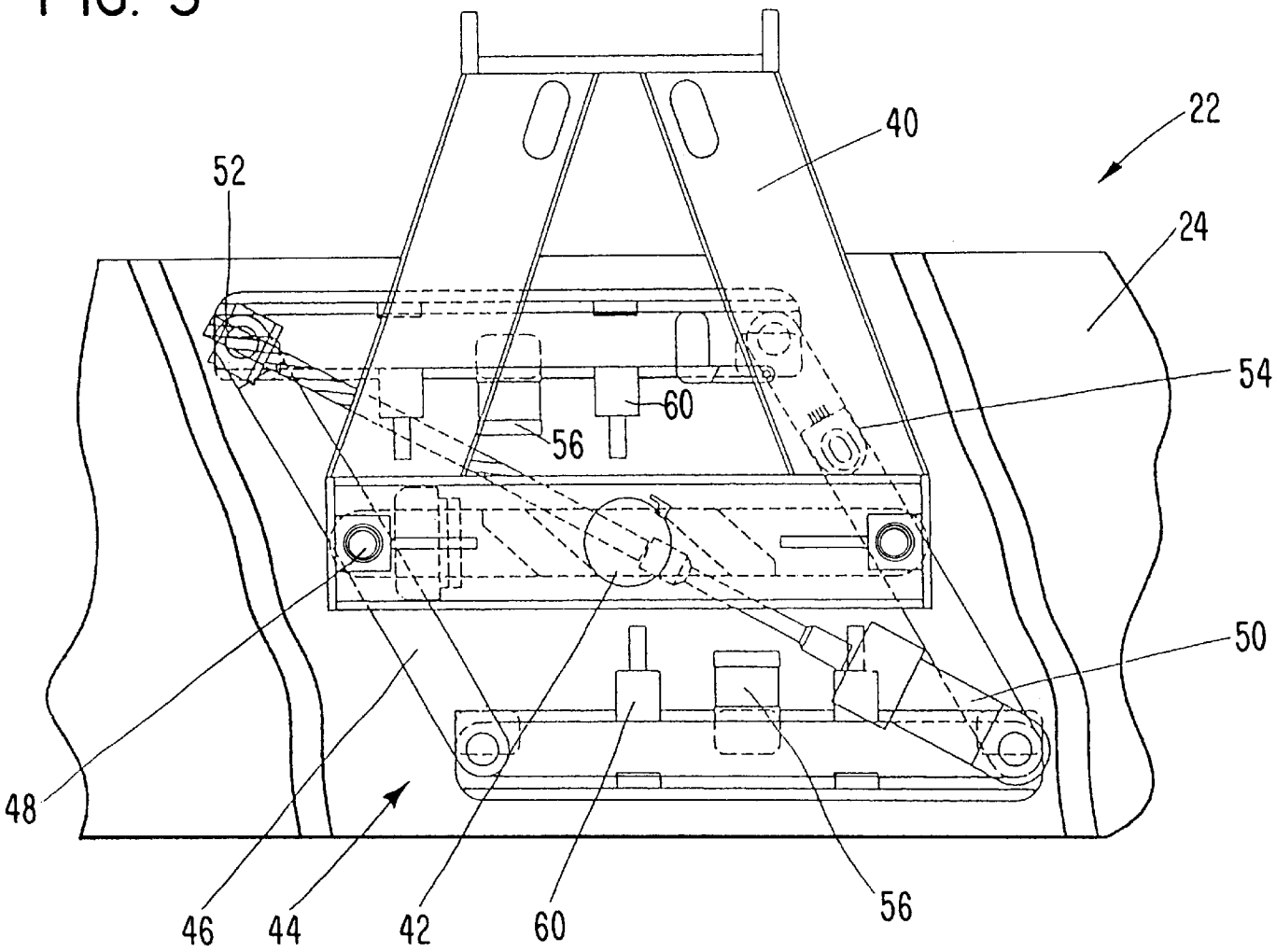
FIG. 3 is an elevational view of the first embodiment of the weft straightener assembly of the present invention in a stretching position.

As seen in FIGS. 2 and 3, the weft straightener assembly 22 employs a mounting structure 40 which supports a cylinder device 42 which elevates and lowers an adjustable frame unit 44. The mounting structure 40 is preferably made from aluminum, but other materials such as steel, aluminum alloys, or reinforced plastics or the like can be employed. The cylinder device 42 is preferably a pneumatic piston cylinder arrangement, but other elevating and lowering mechanisms may be employed such as hydraulic piston cylinder arrangements, extending screw arrangements, or extendible bearings combined with motors. A magnetic reed switch 67 is located on top of the cylinder device 42 so that the central controller 18 can monitor when the adjustable frame unit is in the home or elevated position (see FIG. 4).

The adjustable frame unit 44 includes a plurality of beam structures 46 which have their respective ends connected to each other by pin assemblies 48. The beam structures 46 are preferably made of aluminum, but other materials such as steel, aluminum alloys, or reinforced plastic or the like may be employed. The connections between the beam structures 46 are not limited to the pin assemblies 48 but may include other joint structures such as ball and socket joints, bearing structures, or any mechanical devices which provide pivotable movement between respective beam structures 46. The adjustable frame unit 44 further includes a correctional motor 50 coupled to a lead screw 52 for adjusting the relative positions of the beam structures 46. The correctional motor 50 is preferably a 24 volt dc gear motor but other motors such a stepper motors, hydraulic motors or the like may be employed. The adjustment mechanism of the frame unit 44 is not limited to the lead screw 52 and correctional motor 50 and can include hydraulic or pneumatic piston cylinder arrangements or geared extendible bearings or the like as substitute adjustment mechanisms. Other adjustment mechanisms include shaft and slider arrangements coupled with positioning motors or multiple gear configurations designed to rotate specific beam structures 46.

Figure 4:
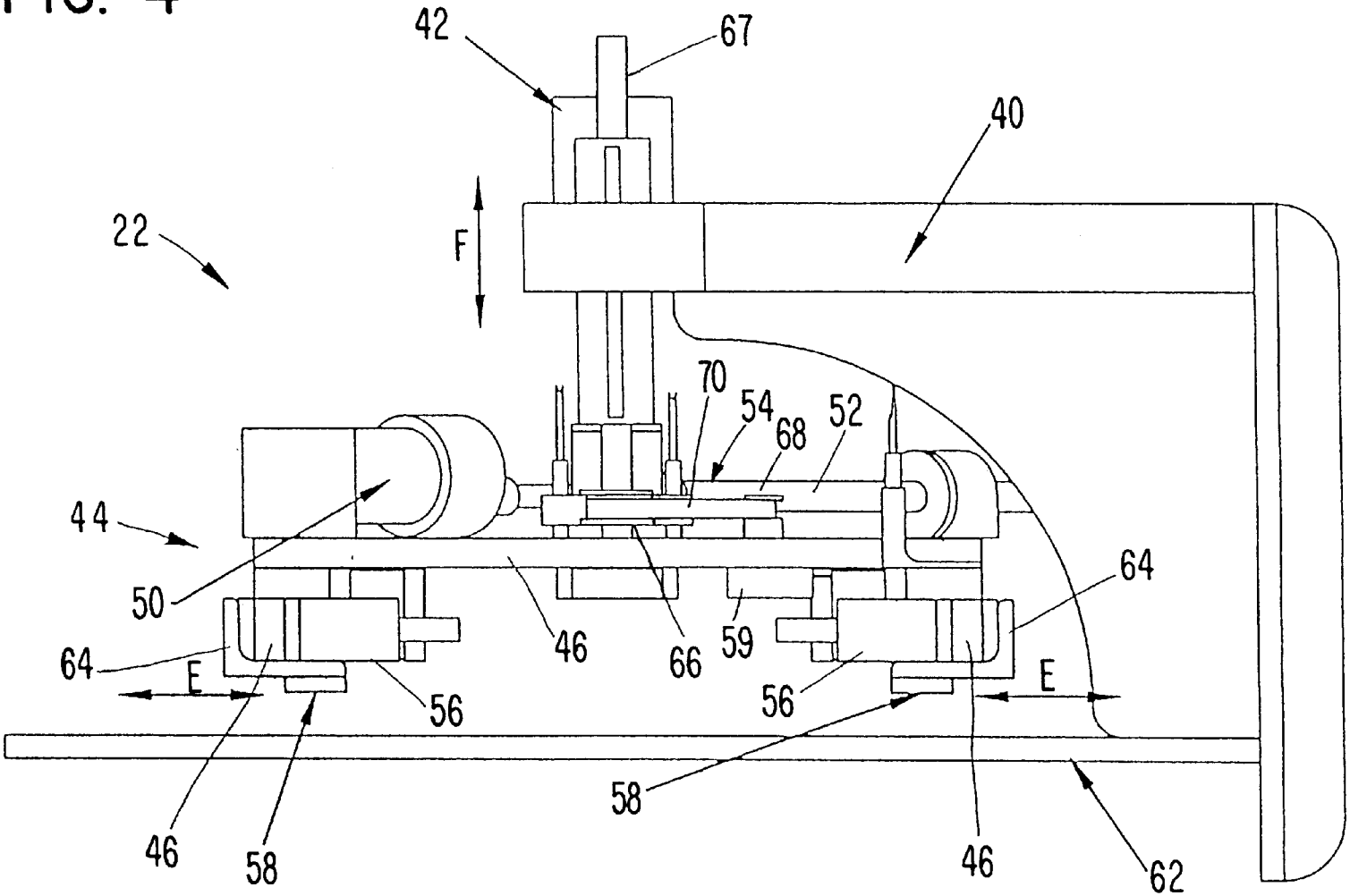
FIG. 4 is a side view of the first embodiment of the weft straightener assembly of the present invention in the home position.

Adjustable frame unit 44 further includes a weft assembly encoder 54 which is electrically linked to a central controller 18. The weft assembly encoder 54 monitors the movement of the adjustable frame unit 44 when the correctional motor 50 is activated. The weft assembly encoder 54 provides count data to the central controller 18 so that the central controller 18 will deactivate the correctional motor 50 when a desired position of the adjustable frame unit 44 is obtained which is proportional to the bias amount data received from the proximity sensors 26. As shown in FIG. 4, weft assembly encoder 54 includes a bearing 66, a pulley 68, a belt 70, and an encoder device 59 connected to the central controller 18. The weft assembly encoder 54 is not limited to these structures and can include other sensing arrangements such as gearing structures or a combination of gearing structures and belt structures which provide relative movement data. Other encoder embodiments include correctional motors where the encoder structure is mounted directly in the correctional motor housing.

Figure 1B:
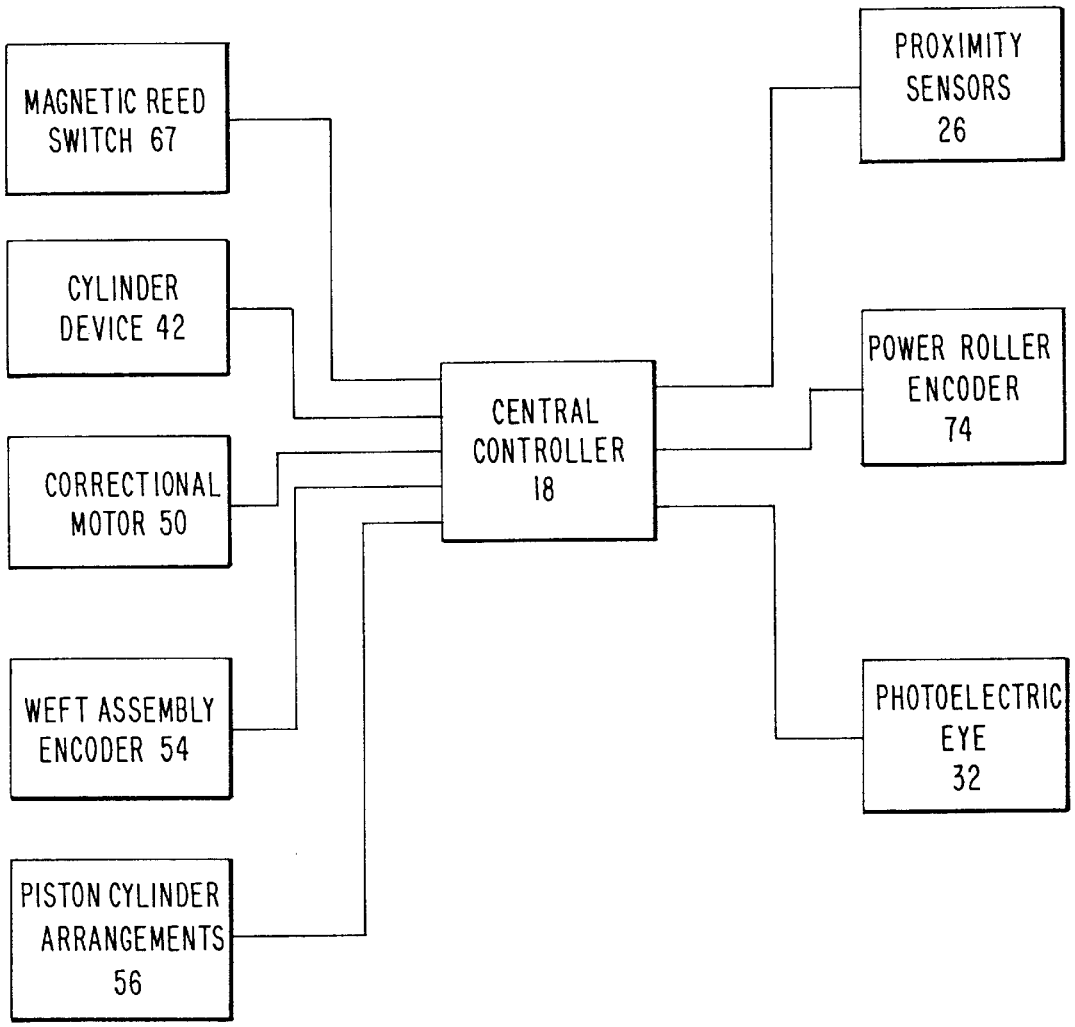
FIG. 1(B) is a schematic of the control system of the automated weft straightener system of the present invention.

Depending on the data received from the proximity sensors 26, the central controller 18 will determine the amount of bias and direction of rotation (clockwise or counterclockwise) of the correctional motor 50 (see FIG. 1(B)). The central controller 18 is preferably a programmable general purpose computer, but can include other devices which are hard wired or preprogrammed (fixed data) electronic devices. Other central controller devices include but are not limited to mechanical configurations which employ multiple gears and/or belts for timing mechanisms.

As seen in FIG. 1(B), the central controller 18 is linked to the following devices: the proximity sensors 26; the power roller encoder 74; the photoelectric eye 32; the magnetic reed switch 67; the cylinder device 42; the correctional motor 50; the weft assembly encoder 54; and the piston cylinder arrangements 56. The central controller 18 determines the bias directional data by monitoring which sensor of at least a pair of proximity sensors 26 is first activated by a plain/cut line. The bias direction data is manipulated by the central controller 18 to determine which direction the correctional motor 50 should be activated (either clockwise or counterclockwise).

The central controller 18 further stores count data from the power roller encoder 74 which works in conjunction with the proximity sensors 26 to provide the bias amount data to the central controller 18. The central controller determines the bias amount data by using encoder counts from the power roller encoder 74 when a first sensor is activated by a plain/cut line 90 (see FIGS. 7(A) and 7(B)) on the woven planar material 24 to when the second sensor of a pair of proximity sensors 26 is activated by the plain/cut line 90. The central controller 18 will use the bias amount data to determine the amount of adjustment needed for the adjustable frame unit 44 through activating correctional motor 50 and monitoring the data provided from the weft assembly encoder 54.

As seen in FIGS. 2 and 3, the adjustable frame unit 44 further includes piston cylinder arrangements 56 which provide extending movement of stretch feet 58. The piston cylinder arrangements 56 are preferably pneumatic but other devices such as hydraulic piston cylinder arrangements, lead screw/motor arrangements or geared extending beam assemblies or the like may be employed. The piston cylinder arrangements 56 extend the stretch feet 58 outwardly relative to the adjustable frame unit 44 to provide a final snap or stretching motion of the weft threads within the woven planar material 24. The adjustable frame unit 44 further includes linear bearings 60 which assist in the movement of the stretch feet 58. The piston cylinder arrangements 56 and linear bearings are connected to respective beam structures 46 on either side of the adjustable frame unit 44.

FIG. 2 shows the adjustable frame unit 44 in a home position which is spaced apart and above the woven planar material 24. In the home position, the adjustable frame unit 44 is substantially square-shaped and permits the woven planar material 24 to flow freely underneath the adjustable frame unit 44. It is noted that arrow C denotes the direction of the woven planar material 24 as it flows from the power roller 28 while arrow D shows the direction of the woven planar material 24 as it flows towards the accumulated loop 38.

In FIG. 3, the adjustable frame unit 44 has been lowered to a down position, extending from the mounting structure 40, where the stretch feet 58 contact the woven planar material 24. In FIG. 3, the correctional motor 50 has already been activated (prior to the stretch feet 58 contacting the woven planar material 24) for a first time interval to adjust the relative position of the beam structures 46 prior to being lowered, so that the stretch feet 58, now in contact with the woven planar material 24, stretch the woven planar material 24 in a direction to substantially reduce any bias present in the woven planar material 24. The adjustable frame unit 44 is substantially shaped in the form of a first parallelogram prior to lowering the frame unit 44 for contacting the woven planar material 24. After stretching the woven planar material 24, the frame unit 44 is also substantially shaped in the form of a second parallelogram, which is oppositely shaped relative to the first parallelogram.

Once the stretch feet 58 contact the woven planar material 24 after being lowered, the correctional motor 50 is actuated for a second time interval for rotating the lead screw 52 in a direction opposite to the rotation direction of the first interval. During this second opposite rotation of the lead screw 52, the stretch feet 58 stretch the woven planar material 24. During the first and second activation time intervals, the correctional motor 50 rotates the lead screw 52 which in turn moves the stretch feet a distance which is substantially proportional to the amount of bias in the woven planar material 24.

It is noted that the present invention is not limited to the square and parallelogram shapes discussed herein. The shape of the adjustable frame unit is dependent on the relative position of the beam structures 46. Therefore, depending on the shape or arrangement of the beam structures 46 at the home and extended positions, the adjustable frame unit 44 can form numerous shapes. Other shapes of the adjustable frame unit 44 include but are not limited to triangular, pentagonal, octagonal, or other polygonal shapes.

In FIG. 4, the adjustable frame unit 44 of the weft straightener assembly 22 is in the home position. Directional arrow F shows the movement of the adjustable frame unit 44 relative to stretch table 62 in response to the cylinder device 42. The stretch feet 58 are preferably straightener gripping pads which are mounted on side angles 64. The stretching feet 58 are not limited to gripping pads but can include other devices made of foamed rubber, hard rubber, or hard plastics or other devices which provide enough friction to securely engage the woven planar material 24 as it is stretched in the predetermined directions. Directional arrow E shows the stretch direction of the stretch feet 58 upon activation of the piston cylinder arrangements 56 for the final snap or stretching motion performed by the weft straightener assembly 22.

Stretch table 62 provides support for the woven planar material when the woven planar material 24 is pinched between the stretch feet 58 and the stretch table 62 in the down or extended or stretching position of the adjustable frame unit 44. The stretch table 62 is preferably a TEFLON™ coated (synthetic resin polymer coating which reduces friction between contacting surfaces) aluminum table top which is substantially smooth. However, other materials for the stretch table 62 may include steel, aluminum alloys, or reinforced plastic with an appropriate coating to reduce friction between the stretch table 62 and the woven planar material 24. Stretch table 62 is designed to provide sufficient support for the woven planar material 24 and the weft straightener assembly 22 so that the stretch feet 58 can grip the woven planar material 24 when the adjustable frame unit 44 is in the down or extended or stretching position.

Figure 5:
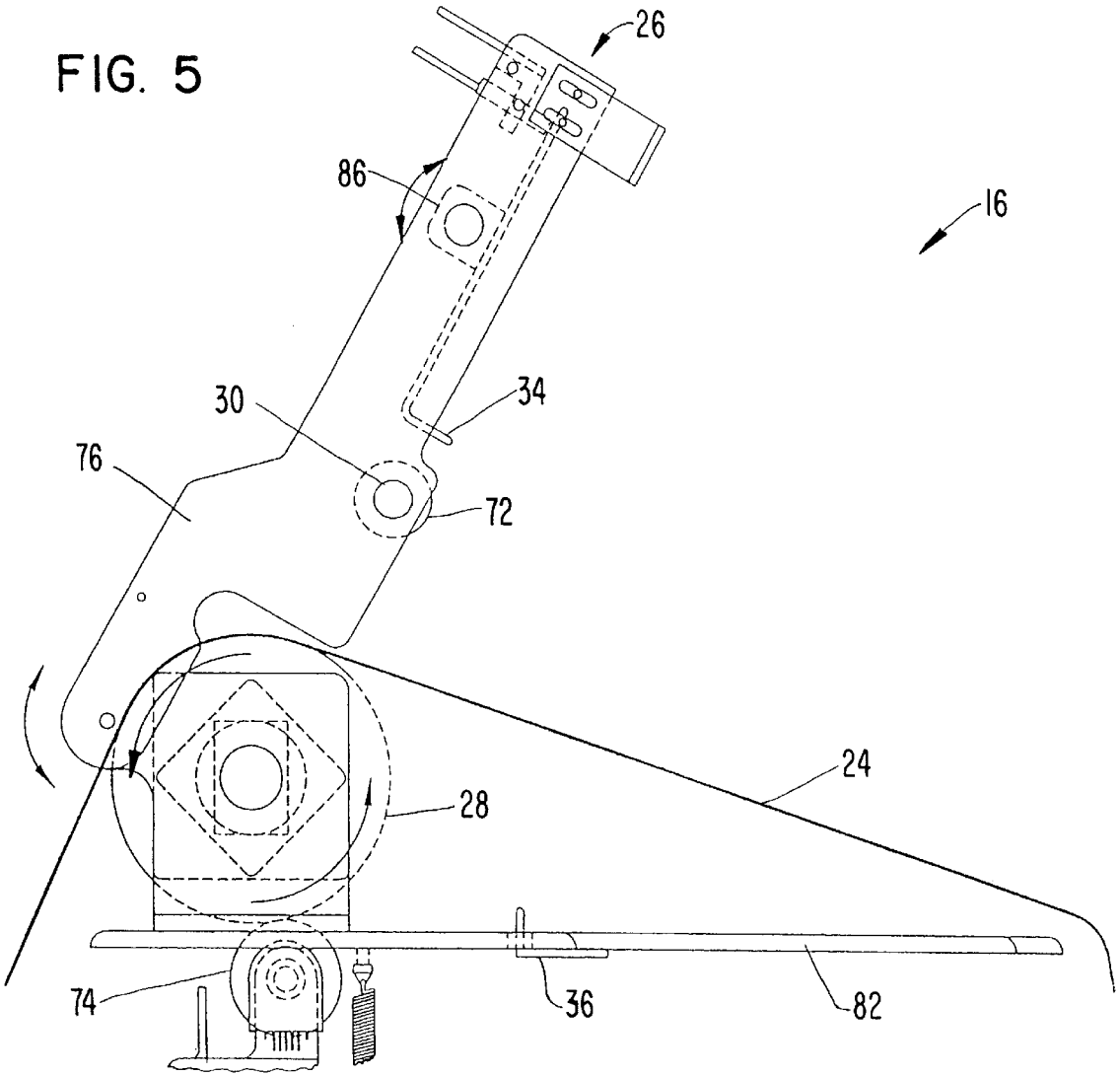
FIG. 5 is a side view of the weft error detection system in a material loading position.

In FIG. 5, the weft error detection system 16 is shown in the material loading position where the woven planar material 24 is fed under an idler roller 72 and over the power roller 28. The proximity sensors 26 each include an upper cut line detector 34 and a lower cut line detector 36. The upper cut line detector 34 of each proximity sensor 26 is mounted on a support arm 76 which is rotatable to permit loading of the woven planar material 24. The power roller 28 works in conjunction with the power roller encoder 74 which provides count data representative of the amount of woven planar material 24 that passes over the power roller 28. The power roller 28 preferably has an electric gear motor built within the roller. However, other motors such as hydraulic motors or stepper motors may be employed in the power roller 58.

The power roller encoder 74 provides data to the central controller 18 where the controller 28 runs the output of the proximity sensors 26 for a predetermined encoded distance of material flow. This predetermined encoded distance of material flow allows a programmable window for operation of the proximity sensors 26 in which the sensors detect a cut mark within the woven planar material 24. The power roller encoder 74 is used by the central controller 18 to count the number of encoder counts from the time a first proximity sensor 78 (see FIG. 8) is turned on or activated to the time that the second proximity sensor 80 is turned on or activated to determine the amount of bias in the woven planar material 24. Frequently, different types of woven textile planar materials have woven borders between cut marks. The proximity sensors 26 are ignored by the central controller 18 for those regions of the woven planar material 24 which include the woven borders. The weft error detection system 16 permits the operator to program and to calculate where a theoretical cut mark should be placed from one predetermined area of the woven planar material 24 to the next predetermined area.

The preferred embodiment of the automated weft straightener system 20 is capable of correcting up to three inches of bias over 12 inches of width of the woven planar material 24. If the programmable window for operation of the sensors is set at three inches, the proximity sensors 26 will not be read by the controller 18 until the theoretical cut line is within three inches of the proximity sensors 26. The proximity sensors 26 will not be read until the theoretical cut line has passed the point of detection by three inches, thus creating a maximum correction of six inches of bias in the woven planar material 24.

The power roller encoder 74 allows the central controller 18 to monitor the amount of material being fed through the entire machine to determine a cut line detection window for a given size area of the woven planar material 24. The power roller encoder 74 is shown to include a roller device, but can include other measuring structures such as gears and/or belts which provide relative movement/count data to the central controller 18. In FIG. 5, a material feed table 82 provides support for the lower cut line detector 36, power roller 28, and support-arm 76.

As seen in FIG. 6, the support arm 76 is in a material loaded position to provide for controlled feeding of the woven planar textile material 24. Support arm pin assembly 84 permits the rotational movement of the support arm 76 relative to the power roller 28 which is rigidly affixed to the material feed table 82.

Figure 7A:
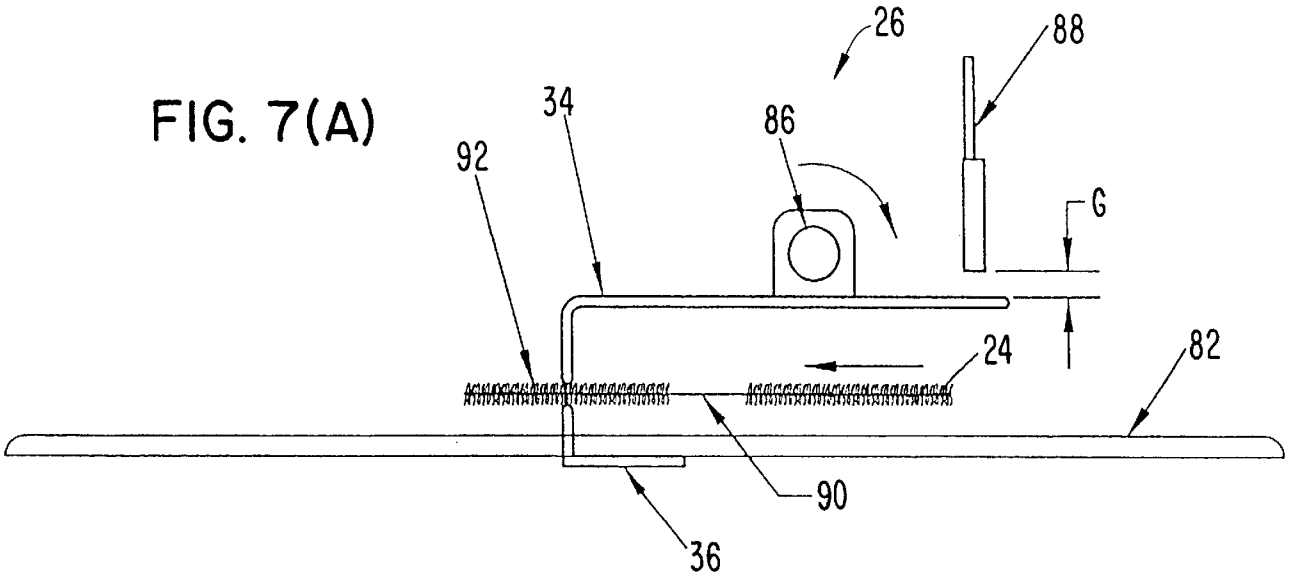
FIGS. 7A and 7B are side views of the proximity sensor of the weft error detection system of the present invention.
Figure 7B:
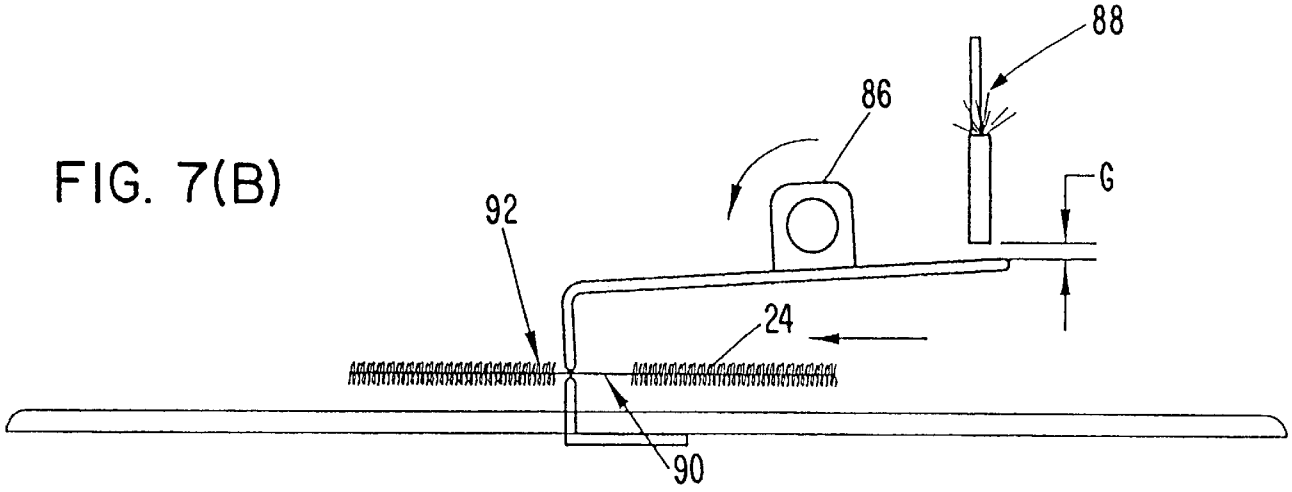
Figure 8:
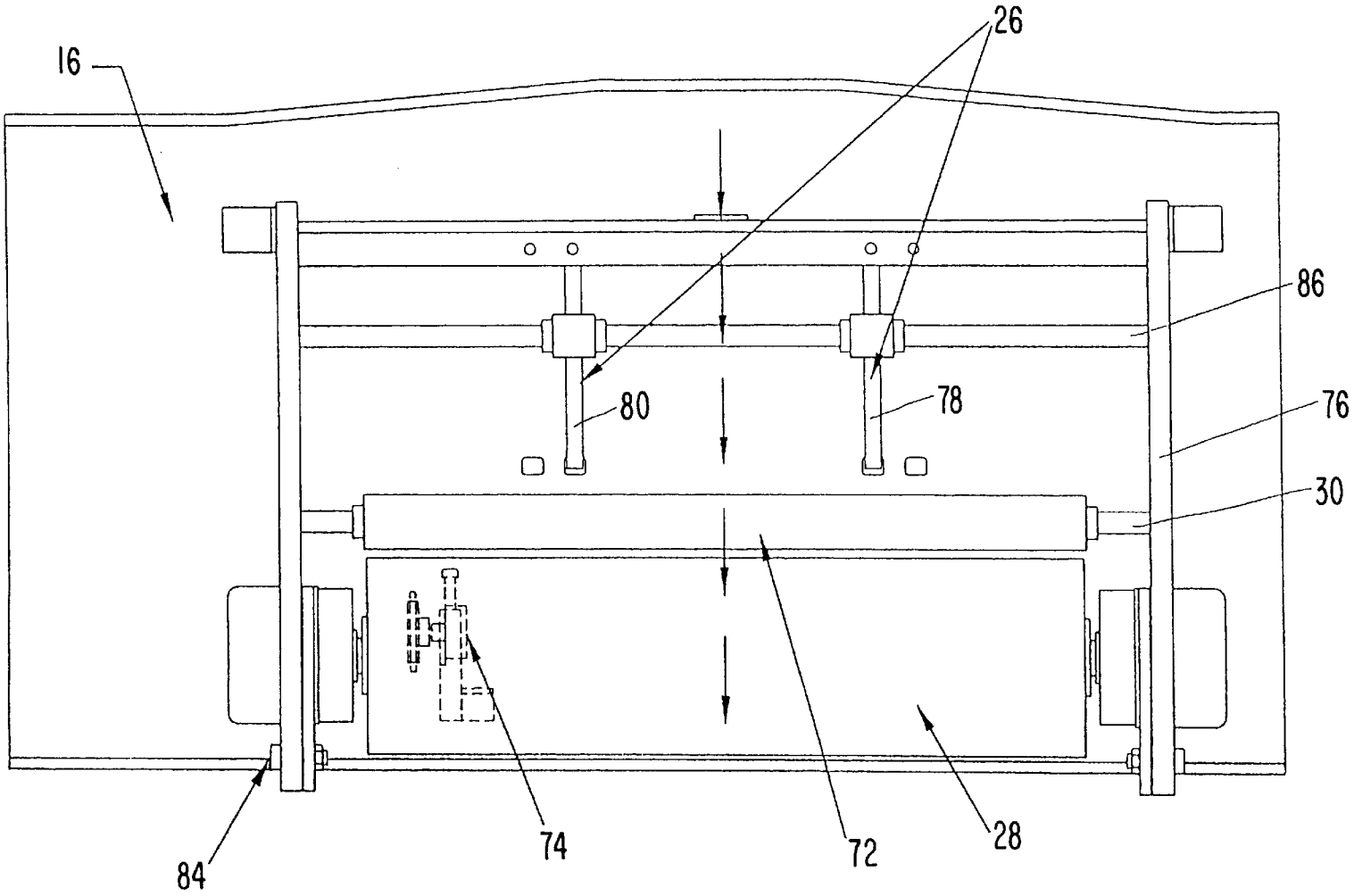
FIG. 8 is an elevational view of the proximity sensors and power and idler rollers of the first embodiment of the present invention.

FIGS. 7A, 7B, and 8 provide further details of the proximity sensors 26. The proximity sensors 26 include an upper cut line detector 34 and a lower cut line detector 36. The lower cut line detector 36 is held stationary by the material feed table 82 while the upper cut line detector 34 is pivotable due to a pivoting device 86. The pivoting device 86 can include a bearing assembly, a pin assembly, or other like rotational mounting structures. The proximity sensors 26 each include an inductive cylinder type proximity switch 88 which senses the relative displacement of the upper cut line detector 34.

The proximity sensors 26, through the inductive cylinder type proximity switch 88, provide bias direction and bias amount data to the central controller 18. The sensors 26 are not limited to the inductive type proximity switches 88 and can include simple mechanical switches, microsonic sensing devices, or other like structures. The proximity switch 88 is activated when the cut line detectors 34 and 36 contact a plain/cut mark 90 present on the woven planar material 24 which passes through the cut line detectors 34, 36.

The upper cut line detector 34 rotates and falls towards the lower cut line detector 36. This movement of the upper cut line detector 34 decreases the relative distance G between the upper cut line detector 34 and the inductive proximity switch 88.

In FIG. 7A, when woven elevated material 92 is present between the cut line detectors 34, 36 the relative distance F between the inductive proximity switch 88 and the upper cut line detector 34 is of a magnitude which does not permit the inductive proximity switch 88 to become activated. The change in the relative distance F due to the plain/cut mark 90 is very small, on the order of magnitude of 1/100 of an inch or less. Since the upper cut line detector 34 is placed directly opposite the lower cut line detector 36, the upper cut line detector 34 will have a maximum displacement which is equal to twice the height of the woven elevated material 92 on one side of the plain/cut mark 90. This maximum displacement increases the sensitivity of the proximity sensors 26 so that a plain/cut mark 90 which is very small can be more readily detected.

The central controller 18 monitors which one of the proximity sensors 26 (either the first proximity sensor 78 or the second proximity sensor 80) of FIG. 8 is activated in order to determine the bias direction present in the woven planar material 24.

In FIG. 8, the physical arrangement of the proximity sensor 26 relative to the power roller 28 is shown. The proximity sensor 26 includes first proximity sensor 78 and second proximity sensor 80. The number of proximity sensors is not limited to the number shown and can include any number of sensors which can readily detect a plain/cut line 90 in a woven planar material 24.

Figure 9:
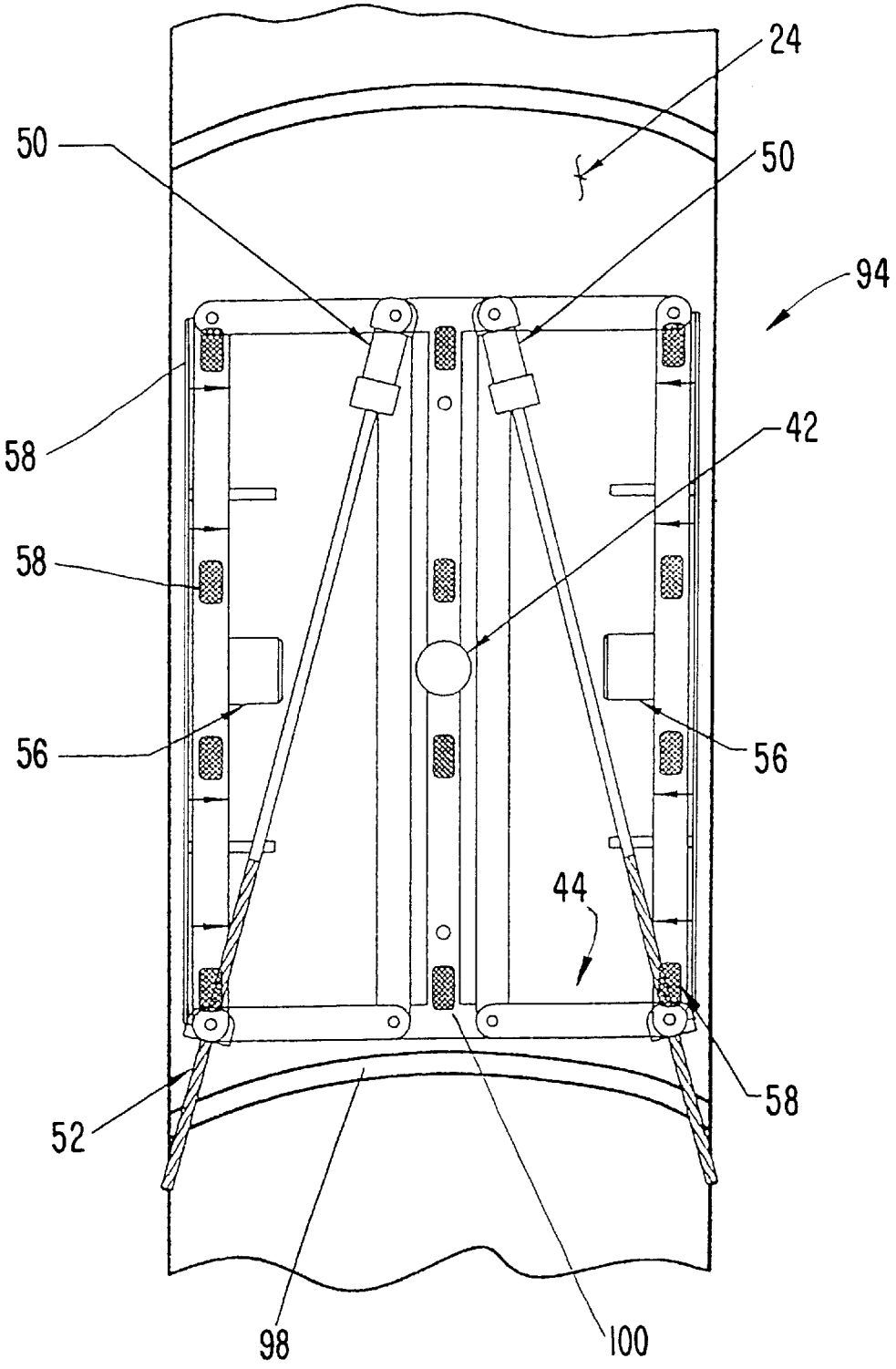
FIG. 9 is an elevational view of the second embodiment of the weft straightener assembly of the present invention is a home position.

In FIG. 9, the second embodiment of the present invention is shown where a multi-axis weft straightener assembly 94 is provided for stretching relatively wide woven planar materials 24, such as towels. FIG. 9 shows the multi-axis weft straightener assembly in an elevated position or home position. The woven planar materials 24 in this second embodiment are not limited to towels and can include sheets, blankets, or other relatively large woven planar materials. The multi-axis weft straightener assembly 94 requires at least three cut line detectors 96 (see FIG. 14). Each end detector of the three cut line detectors 96 would compare the plain/cut line mark relative to a center detector of the three cut lines detectors 96. Unlike the single axis unit, the multi-axis weft straightener assembly also corrects for concave and convex bias present in the woven planar material 24. The multi-axis weft straightener assembly further includes additional correctional motors 50 and lead screws 52 in order to adjust relative sides of the multi-axis weft straightener assembly 94. The correctional motors 50 of this embodiment have encoder assemblies mounted in the housings of the motors. As noted above, weft assembly encoders are not limited to these structures and can include other sensing arrangements such as belt and pulley arrangements, gearing structures or a combination of gearing structures and belt structures which provide relative movement data.

Figure 10:
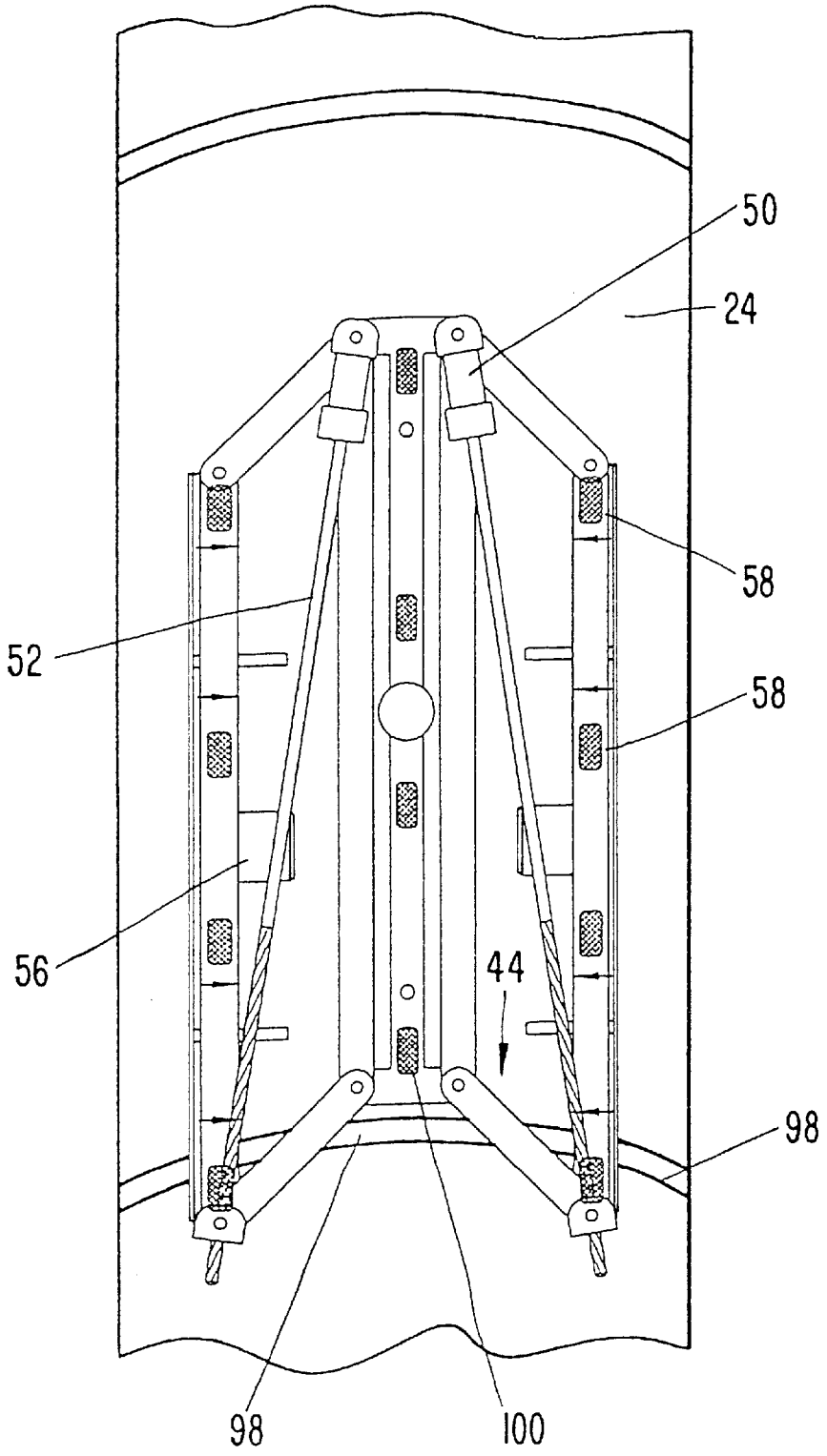
FIG. 10 is an elevational view of the second embodiment of the weft straightener assembly of the present invention in a stretching position.

FIG. 10 shows the multi-axis weft straightener assembly 94 in the stretching position where the correctional motors 50 have been activated to turn the lead screws 52 to adjust the shape of the adjustable frame unit 44 (prior to contacting the woven planar material 24) in order to correct the concave bias 98 present in the woven planar material 24. Once the frame unit 44 has been adjusted to the stretching position, the frame unit 44 is then lowered onto the woven planar material 24 by the cylinder device 42. It is noted that the stretch feet 58 are in the retracted positions. It is further noted that the cut line detectors 96 of the multi-axis weft straightener assembly 94 are microsonic sensing units as opposed to pivotable cut line detectors 34, 36.

Figure 11:
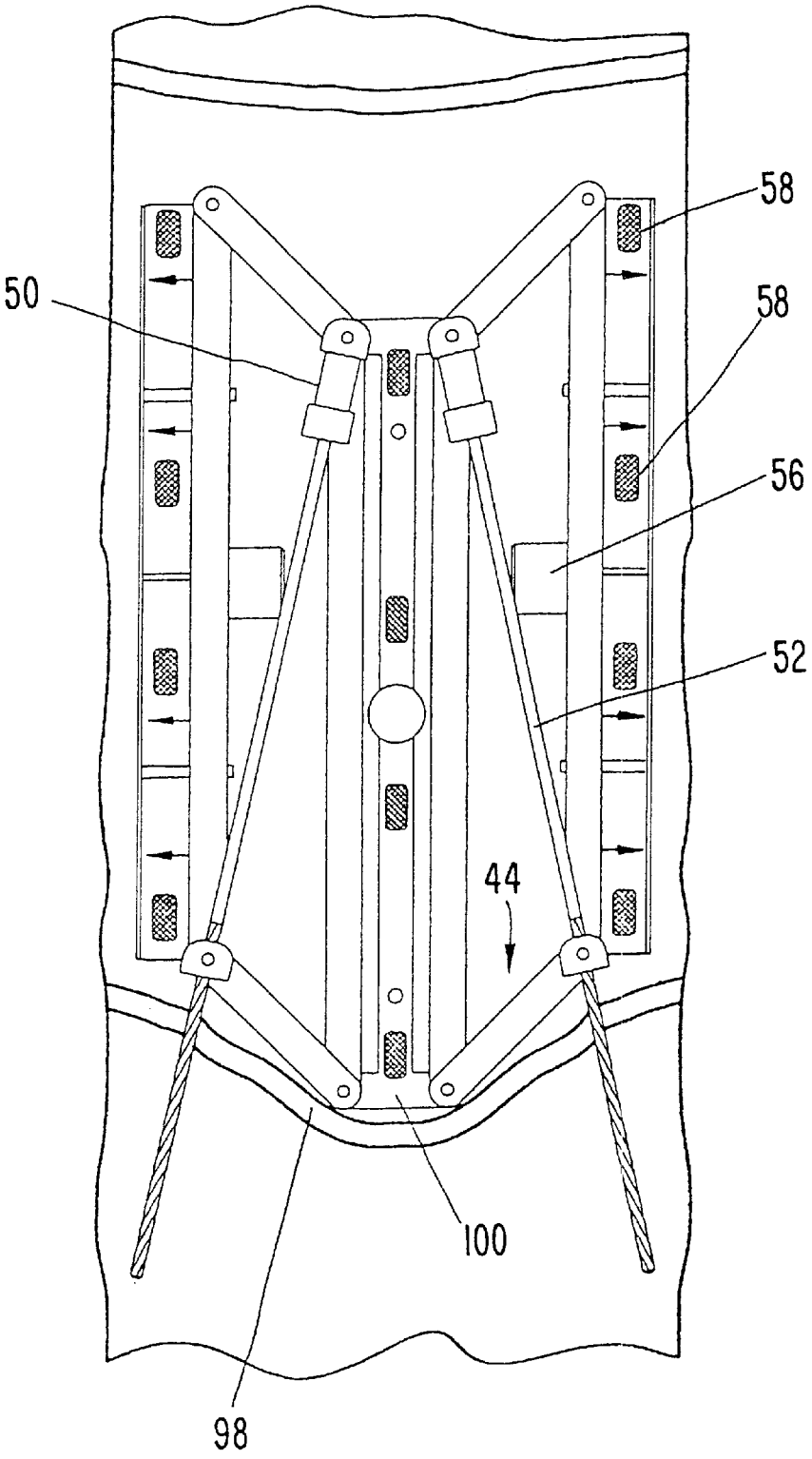
FIG. 11 is an elevational view of the second embodiment of the weft straightener assembly of the present invention in a stretching position with stretch feet extended.

In FIG. 11, the movable beam structures 46 of the multi-axis weft straightener assembly 94 are moved in a direction opposite to the bias 98 present in the woven planar material 24 by motors 50 which rotate the lead screws 52 in a direction opposite to the direction when the assembly 94 was in the stretching position. It is further noted that the multi-axis weft straightener assembly 94 has a central beam structure 100 with feet 58 which is stationary relative to the movable beam structures 46. The shape of the adjustable frame unit 44 is characterized as a polygonal shape in this extended or stretching position. FIG. 11 further shows the activation of the piston cylinder arrangements 56 where the stretch feet 58 are extended after the correctional motors 50 stop to provide a final snap or stretching motion of the weft threads within the woven planar material 24.

Figure 12:
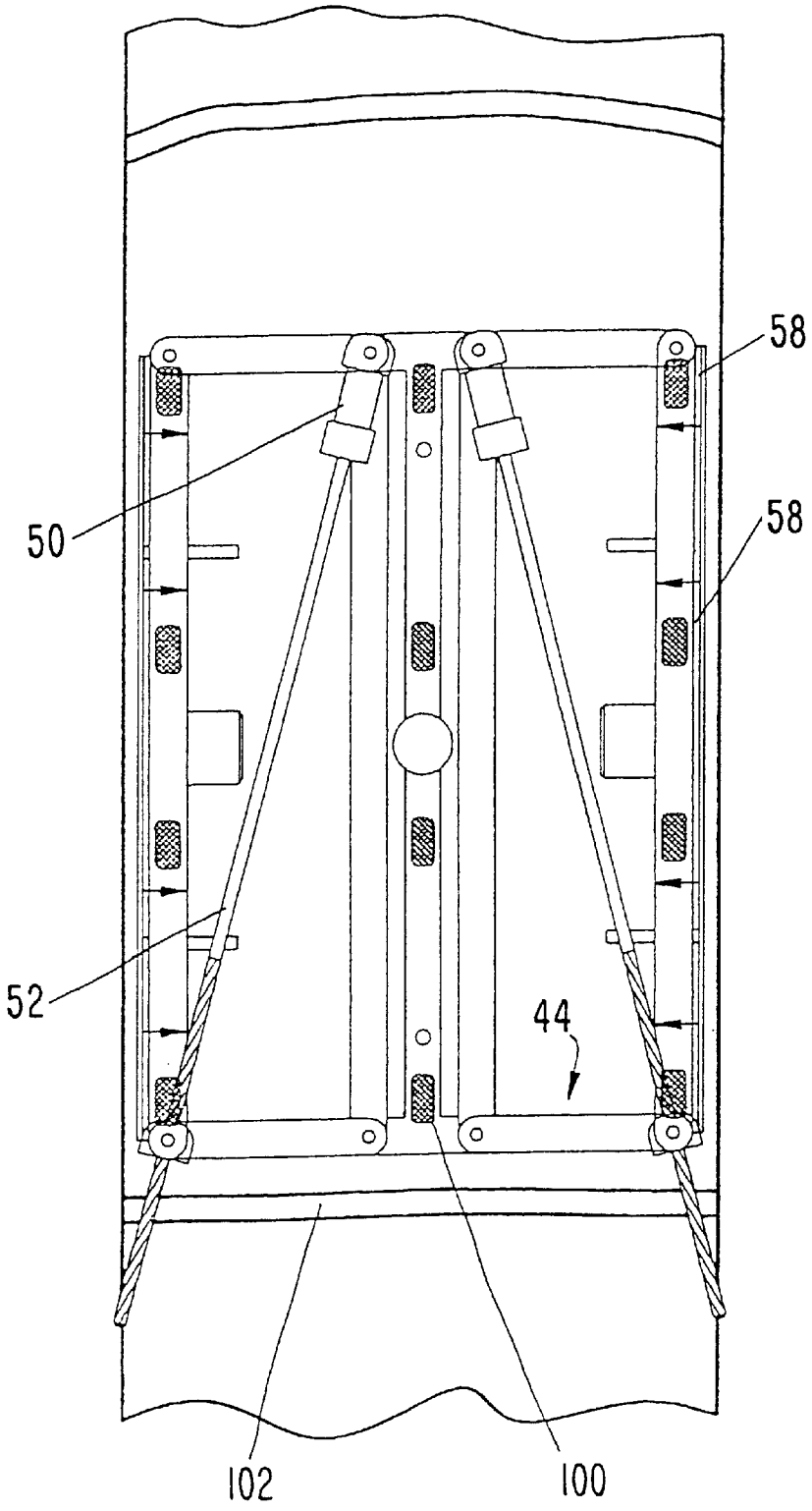
FIG. 12 is an elevational view of the second embodiment of the weft straightener assembly of the present invention in a home position after the bias in the planar material has been corrected.

In FIG. 12, the multi-axis weft straightener assembly is in the home position and the bias has now been corrected to a relatively straight configuration 102. The stretch feet 58 are returned to their retracted positions. The shape of the adjustable frame unit is relatively rectangular in the home or elevated position. As noted above, the present invention is not limited to the rectangular and polygonal shapes discussed herein. The shape of the adjustable frame unit 44 is dependent on the relative position of the movable structures 46. Therefore, depending on the shape or arrangement of the movable beam structures 46 at the home and extended positions, the adjustable frame unit 44 can form numerous shapes.

Figure 13:
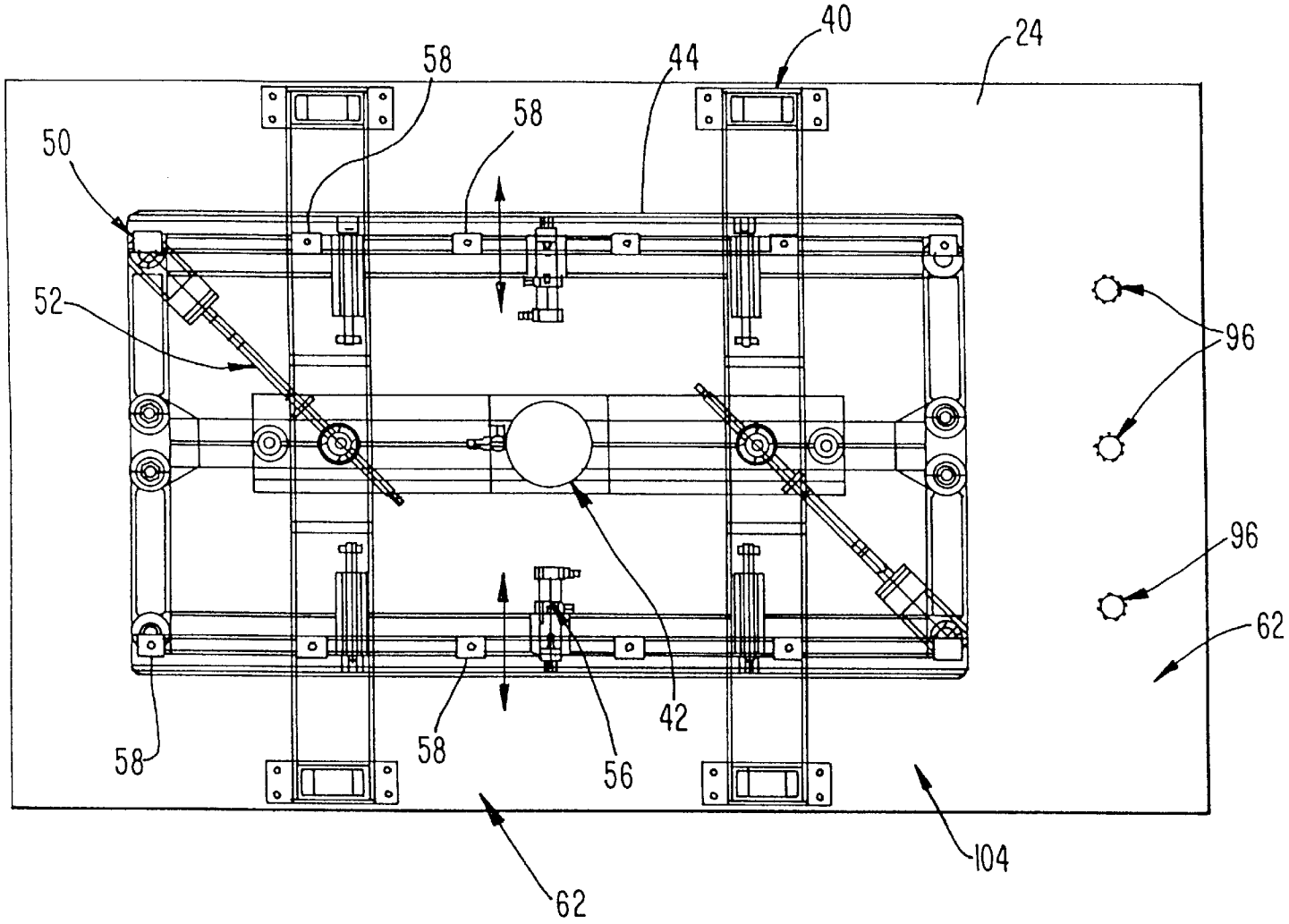
FIG. 13 is an elevational view of a third embodiment of the weft straightener assembly of the present invention in a home position.

In FIG. 13, a third embodiment of the present invention is shown where a multi-axis weft straightener assembly 104 includes correctional motors 50 located on opposite corners of the adjustable frame unit 44. The multi-axis weft straightener assembly 104 is changed from a rectangular shape in the home position to a parallelogram shape in the extended position where the stretch feet 58 contact the woven planar material 24. The stretch table 62 includes the three cut line detectors 96. The correctional motors 50 of this embodiment have encoder assemblies mounted in the housings of the motors. As noted above, weft assembly encoders are not limited to these structures and can include other sensing arrangements such as belt and pulley arrangements, gearing structures or a combination of gearing structures and belt structures which provide relative movement data.

Figure 14:
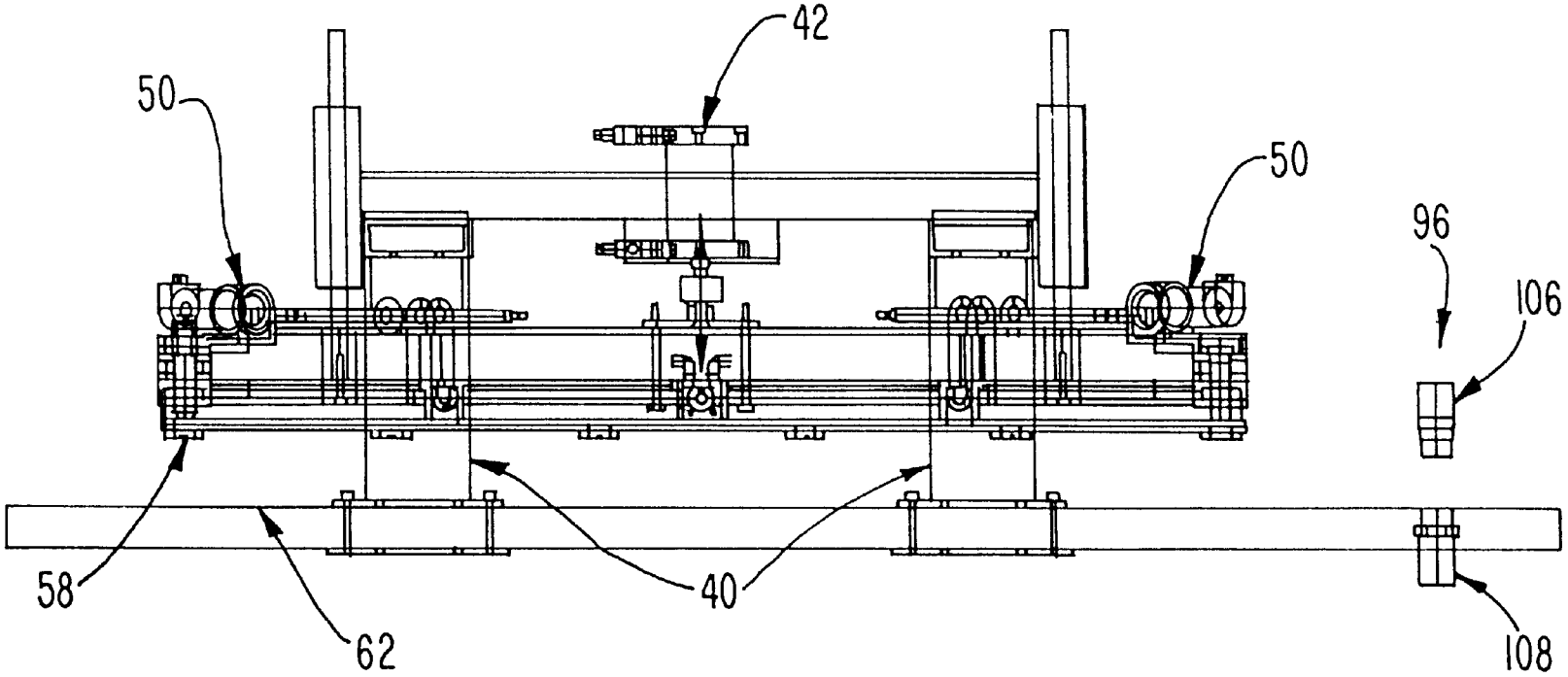
FIG. 14 is a side view of the third embodiment of the weft straightener assembly of the present invention in a home position.

As seen in FIG. 14, three cut line detectors 96 each include a microsonic transmitter 106 and a microsonic receiver 108 to determine the plain/cut mark in the woven planar material 24. While microsonic cut line detectors 96 and pivotable mounted cut line detectors 34, 36 are used in the present invention, any type of sensory devices can be used which can reliably sense the plain/cut line mark 90.

The weft straightener assembly of each embodiment of the present invention provides a method of eliminating bias in a planar material. The method steps include detecting bias direction data and bias degree data through the sensors 26 and transmitting the bias direction and bias degree data to the central controller 18. While feeding the woven planar material 24 with the power roller 28, the steps of calculating a predetermined stop position and a predetermined stretch direction are performed by the central controller 18. Next, the woven planar material 24 is stopped at the predetermined plain/cut mark position 90. The adjustable frame unit 44 is manipulated into a stretching position. The adjustable frame unit 44 having stretch feet 58 is then lowered where the stretch feet 58 contact the woven planar material 44.

The woven planar material 24 is pressed with the stretch feet 58 against a stretch table 62. The correctional motor 50 is activated to move the stretch feet 58 in a predetermined stretch direction. Once the correctional motor 50 stops, the piston cylinder arrangements 56 are activated where the stretch feet 58 stretch the planar material 24 in a direction different (preferably perpendicular to a side of the adjustable frame unit 44) from the stretch direction, whereby bias in the woven planar material is substantially reduced. It is noted that when the piston cylinder arrangements 56 extend the stretch feet 58 in a direction different from the stretch direction, where this movement provides the final snap or stretching motion of the weft threads of the woven planar material 24.

With the present invention, the weft straightener system 20 eliminates or substantially reduces bias in woven planar materials 24 by stretching the materials in an opposite diagonal direction relative to the bias. The present invention senses the amount and direction of the bias in the woven planar materials and corrects the bias in accordance with these sensed data parameters. The weft straightener system 20 closely parallels manual stretching of the woven planar materials but permits the continuous movement of woven planar materials 24 in an automated process. The automated weft straightener system 20 provides a weft correction process with an automatic machine which performs with fewer errors to increase the quality control of the woven textile planar materials 24. The present invention significantly reduces the idle time in the manufacturing of woven textile planar materials 24. The weft correction system 20 reduces the possibilities of long term injuries sometimes associated with the repetitive manual processes of weft correction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An automated weft straightener system for detecting and for reducing the bias from a woven planar material, the system comprising:

a central controller;

bias detection means for detecting the direction of and amount of bias in a woven planar material and for sending a signal to the central controller indicating the direction and degree of bias; and a weft straightener assembly, responsive to said central controller, for stretching a woven planar material in a direction opposite to the direction of the bias as detected by the bias detection means with sufficient force to effectively reduce the bias, said weft straightener assembly comprising:

first central member disposed adjacent to a central region of a woven planar material and aligned with a defined reference direction;

second and third members, disposed on opposite sides of the first central member, for engaging the woven planar material outside the central region and for movement relative to the first central member for stretching the woven planar material; and means for moving the second and third members responsive to the central controller for reducing bias in the woven planar material.

2. The automated weft straightener system of claim 1, further comprising:

means for advancing a woven planar material along a path with a defined reference direction; and said bias detection means further comprising proximity sensors for determining the amount and degree of bias in a woven planar material by detecting the orientation of the woven planar material with respect to the defined reference direction.

3. The automated weft straightener system of claim 1, wherein said second and third members move both in a direction along the defined reference direction and in a direction substantially perpendicular to the defined reference direction.

4. The automated weft straightener system of claim 3, further comprising:

second moving means for moving the second and third members in a direction substantially perpendicular to the defined reference direction.

5. The automated weft straightener system of claim 1, further comprising:

means for moving the weft straighter assembly between a home position above a woven planar material and an extended position in contact with the woven planar material.

6. The automated weft straightener system of claim 1, wherein the second and third members are moved in the same direction with respect to the first central member.

7. The automated weft straightener system of claim 3, wherein the second and third members are moved in opposite directions with respect to the first central member.

8. The automated weft straightener system of claim 1, the second and third members having frictional engaging members for contacting the woven planar material.

9. The automated weft straightener system of claim 8, wherein the first central member having frictional engaging members for contacting the woven planar material.

10. A weft error detection system for detecting a direction and amount of bias in a woven planar material, the detection system comprising:

a central controller;

means for advancing a woven planar material along a path with a defined reference direction; and proximity sensors for determining the amount and degree of bias in a woven planar material by detecting the orientation of the woven planar material with respect to the defined reference direction according to a thickness measurement of the woven planar material, said sensors sending a signal to the central controller indicating the direction and degree of bias.

11. The weft error detection system for detecting a direction and amount of bias in a woven planar material of claim 10, the proximity sensors further comprising:

a first sensor for detecting a change in thickness of a first area of a woven planar material as it is advanced by said advancing means along the defined reference direction and producing a signal to the central controller;

a second sensor, spaced from the first sensor, for detecting a change in thickness of a second area of the woven planar material as it is advanced by said advancing means along the defined reference direction and for producing a signal to the central controller; and wherein the central controller compares the respective signals of the first and second sensors to determine the amount and degree of bias in a woven planar material.

12. The weft error detection system for detecting a direction and amount of bias in a woven planar material of claim 11, wherein:

said proximity sensors are located along a line substantially perpendicular to the defined reference direction.

13. A method for automatically reducing the bias in a woven planar material, the method comprising:

automatically detecting the direction and amount of bias in a woven planar material by detecting the orientation of the woven planar material with respect to the defined reference direction according to a thickness measurement of the woven planar material;

stretching a woven planar material in a direction opposite to the direction of the bias as determined in said detecting step; and advancing a woven planar material along a path with a defined reference direction.

14. The method of automatically reducing the bias in a woven planar material ply of claim 13, the method further comprising:

calculating a predetermined stop position and a predetermined stretch direction;

stopping a woven planar material at the predetermined stop position;

lowering a weft straightener assembly onto the woven planar material;

pressing the woven planar material with said woven weft straightener assembly against a stretch table; and stretching the woven planar material with said weft straightener assembly in the predetermined stretch direction.

15. The method of automatically reducing the bias in a woven planar material of claim 14, the method further comprising:

extending frictional engaging members for contacting the woven planar material in a direction away from said weft straightener assembly to provide stretching of the woven planar material in a direction different from the predetermined stretch direction.

16. An automated weft straightener system for detecting and for reducing the bias from a woven planar material, the system comprising:

a central controller;

bias detection means for detecting the direction of and amount of bias in a woven planar material according to a thickness measurement of the woven planar material and for sending a signal to the central controller indicating the direction and degree of bias; and a weft straightener assembly, responsive to said central controller, for stretching a woven planar material in a direction opposite to the direction of the bias as detected by the bias detection means with sufficient force to effectively reduce the bias.

17. The automated weft straightener system of claim 16, further comprising:

means for advancing a woven planar material along a path with a defined reference direction; and said bias detection means further comprising proximity sensors for determining the amount and degree of bias in a woven planar material by detecting the orientation of the woven planar material with respect to the defined reference direction.

18. The automated weft straightener system of claim 17, said proximity sensors comprising:

a first sensor for detecting a change in thickness of a first area of a woven planar material as it is advanced by said advancing means along the defined reference direction and producing a signal to the central controller;

a second sensor, spaced from the first sensor, for detecting a change in thickness of a second area of the woven planar material as it is advanced by said advancing means along the defined reference direction and for producing a signal to the central controller; and wherein the central controller compares the respective signals of the first and second sensors to determine the amount and degree of bias in a woven planar material.

19. The automated weft straightener system of claim 16, said proximity sensors are located along a line substantially perpendicular to the defined reference direction.

* * * * *